US008505267B2

(12) United States Patent
Martin Hernandez

(10) Patent No.: US 8,505,267 B2
(45) Date of Patent: Aug. 13, 2013

(54) HOLDER FOR BEING POSITIONED IN FLOATING FLOOR SLABS AND INSTALLATION SYSTEM THEREOF

(76) Inventor: Juan Jose Martin Hernandez, El Astillero (ES)

( * ) Notice: Subject to any disclaimer, the term of this patent is extended or adjusted under 35 U.S.C. 154(b) by 0 days.

(21) Appl. No.: 13/463,320

(22) Filed: May 3, 2012

(65) Prior Publication Data

US 2012/0210656 A1 Aug. 23, 2012

Related U.S. Application Data

(63) Continuation-in-part of application No. 12/668,890, filed as application No. PCT/ES2008/000469 on Jul. 1, 2008, now abandoned.

(30) Foreign Application Priority Data

Jul. 13, 2007 (ES) ..... 200701966

(51) Int. Cl.
*E04C 5/16* (2006.01)
*E02D 35/00* (2006.01)

(52) U.S. Cl.
USPC ..... 52/749.11; 52/677; 52/125.1

(58) Field of Classification Search
USPC ..... 52/749.11, 687, 688, 677, 125.1
See application file for complete search history.

(56) References Cited

U.S. PATENT DOCUMENTS

| | | | | |
|---|---|---|---|---|
| 3,387,423 | A * | 6/1968 | Andersen | 52/678 |
| 4,793,104 | A * | 12/1988 | Hultberg et al. | 52/127.3 |
| 5,822,946 | A * | 10/1998 | Rasmussen | 52/687 |
| 5,878,546 | A * | 3/1999 | Westover | 52/686 |
| 6,282,860 | B1 * | 9/2001 | Ramirez | 52/677 |
| 7,108,453 | B2 * | 9/2006 | Harris | 404/135 |
| 7,204,064 | B2 * | 4/2007 | Cazzolaro | 52/645 |
| 8,099,925 | B1 * | 1/2012 | Coons | 52/686 |
| 2008/0028718 | A1 * | 2/2008 | Erickson et al. | 52/687 |

* cited by examiner

*Primary Examiner* — Mark Wendell
(74) *Attorney, Agent, or Firm* — Kirton McConkie; Evan R. Witt

(57) ABSTRACT

A holder to be placed in floating floor slabs and the installation system thereof, the holder comprising a cubic holder having a pair of tubes on each side thereof, parallel with the supporting base, with facing sides in identical position; within said sides a section designed for placing rods on which the different layers of the rebar mesh are supported and a system for fitting the mesh on the rods, and also the securing of the corners of the different levels of the rebar mesh by means of linking of the holder s using the rods.

15 Claims, 5 Drawing Sheets

HOLDER FOR BEING POSITIONED IN FLOATING FLOOR SLABS AND INSTALLATION SYSTEM THEREOF

RELATED APPLICATIONS

The present application is a continuation-in-part application of U.S. application Ser. No. 12/668,890 filed Jan. 13, 2010 now abandoned as a National Stage Application of PCT/ES08/00469, filed Jul. 1, 2008, claiming priority of Spanish Application No. P200701966, filed Jul. 13, 2007.

FIELD OF THE INVENTION

The technical field of the present invention pertains to a holder, which is integrated into the framework of floating slabs in the form of a poured concrete forgings, as a mechanical accessory for raising the forging once the concrete has set. These floating slabs are arranged in constructions that require an insulation of the central block, as they may be the supporting bases on which are situated electric transformers, air conditioning units, bowling alleys and, generally, sites at which it is desired to avoid the transmission of vibrations and impact noises. The technical field of the present invention pertains to a holder, which is integrated into the framework of floating slabs, and includes an accessory for raising the slab once the concrete has set. These floating slabs are arranged in constructions that require an insulation of the central block, as they may be the supporting bases on which are situated electric transformers, air conditioning units, bowling alleys and, generally, sites where it is desired to avoid the transmission of vibrations and impact noises.

BACKGROUND OF THE INVENTION

The system of creating floating slabs by means of distributing metallic containers in welded wire fabric in the form of hollow cubes that are within the forging is known. The raising phase occurs once the concrete has set, and mechanical accessories in the form of shock-absorbing elements are positioned in the hollow interiors of the holders which are coupled under beveled ribs that are located in two of the corners thereof. In this way, the raising of the floating slab will be achieved to the extent desired by means of the pressure of the shock absorbers in its upper part.

The welded wire fabric is usually formed by two mesh structures, each of which are created by wires that intersect one another at right angles, forming grids, whose points of contact are joined by welding. These are positioned superimposed, trying to align the grids of the two meshes for the correct insertion of holders which have a height equal to the height of the slab containing the welded wire fabrics, and are positioned within the interstices of the two meshes, so that, after the setting of the concrete, the meshes are closely aligned in the slab. For this purpose, a plurality of metallic rods are installed welded on the surface of each holder in the horizontal direction which protrude from their structure. In fixing to the rebar, in order to avoid the displacement thereof in the pouring phase of the concrete, once in the grid, the rods are fastened to the welded wire fabric by means of wires. This involves a lot of work for the operator in the positioning and a limited rigidity of the system, causing the holders to move when the concrete is poured or by the operator's own movements within the rebar. If the setting occurs with any of these elements displaced or twisted, there will be a weak zone at this point which may cause the fracture of the floating slab in the raising phase.

The grid of the welded wire fabric is produced by having different proportions. The prior-art system has the drawback that the rods welded to the structure of the holder are arranged so that they overlie the grid in every case, to facilitate its bundling by means of wire. For this the operator usually has problems at the time of fitting the holder in the welded wire fabric, and has to shorten the rebar to make a suitable cavity in the mesh to receive he holder. Apart from the labor-intensive work that it involves, it results in a structure that is hazardous to the work zone. Where the ends of the rods are welded together, and where the cuts made in the rebar result in many sharp points, thee is a risk to the operator in the work of positioning the wires or merely by the operator's being situated on the structure.

The welded wire fabric is manufactured in different extension dimensions for the different positioning sites. For this, the bonding of one surface of the welded wire fabric with those surfaces which follow it in the work is necessary. It is equally necessary to anchor the corners of the layers of the welded wire fabric, if a worker or operator goes through zones remote from the center, and creates a force on one or both of the layers, this force then causes the structure to rise.

Another type of element is known for positioning shock absorbers in the forging that is made up of a metallic cylinder with walls of considerable size, within which the shock absorber is arranged, having two horizontal projections in its contour for being situated in the rebar. The complexity of this structure makes the manufacture thereof very expensive, and the securing in the welded wire fabric, in spite of the weight that it has, is insufficient.

DESCRIPTION OF THE INVENTION

The present invention that is proposed fully solves the problems mentioned by presenting a holder in the form of a holder which has various horizontal tubes in its perimetral structure, at various levels. The tubes are suitable to receive rods being inserted therein, which rods may project beyond the sides of the holder for supporting the different layers of welded wire fabric above them. In this way, the first layer of the welded wire fabric will rest on the rods arranged in the lower tubes of the holder, which are facing on two of its sides; a second welded wire fabric arranged above the rods of the upper tubes, placed on the other two opposite sides of the holder.

The bonding of the different mesh structures of the work is carried out by means of the rods installed in the lower tubes which support the first welded wire fabric, which connect the holders of the adjoining mesh surfaces.

Rods will be placed in the upper tubes parallel to the above tubes for the bonding of two adjacent holders which are close to the corners of two welded wire fabric surfaces. This upper linking together will prevent the raising of the mesh when a pressure goes or is applied outside of the central zone.

The object of the present invention is accomplished with a lid and a supporting base for the interior insulation in the pouring of the concrete.

DESCRIPTION OF THE DRAWINGS

To complement the description that is being provided and to aid in a better understanding of the features of the present invention, the present specification is accompanied by drawings showing the preferred embodiment, in which, in an illustrative and nonlimiting nature.

PREFERRED EMBODIMENT OF THE INVENTION

Viewing the figures shown, it can be seen how the holder (6) for positioning floating slabs is composed of a metallic hollow cube having beveled ribs (6') to mount the mechanical accessories used in the raising phase. The cube 6 is smaller in outride dimensions than the interstice of the grid of the mesh and has a height equal to that of the forging which forms the slab. The four sides of the holder have identical tubes (1, 1', 2, 2, 3, 3', 4, 4'), which are preferably attached to the holder 6 by means of welding.

Figure 3:
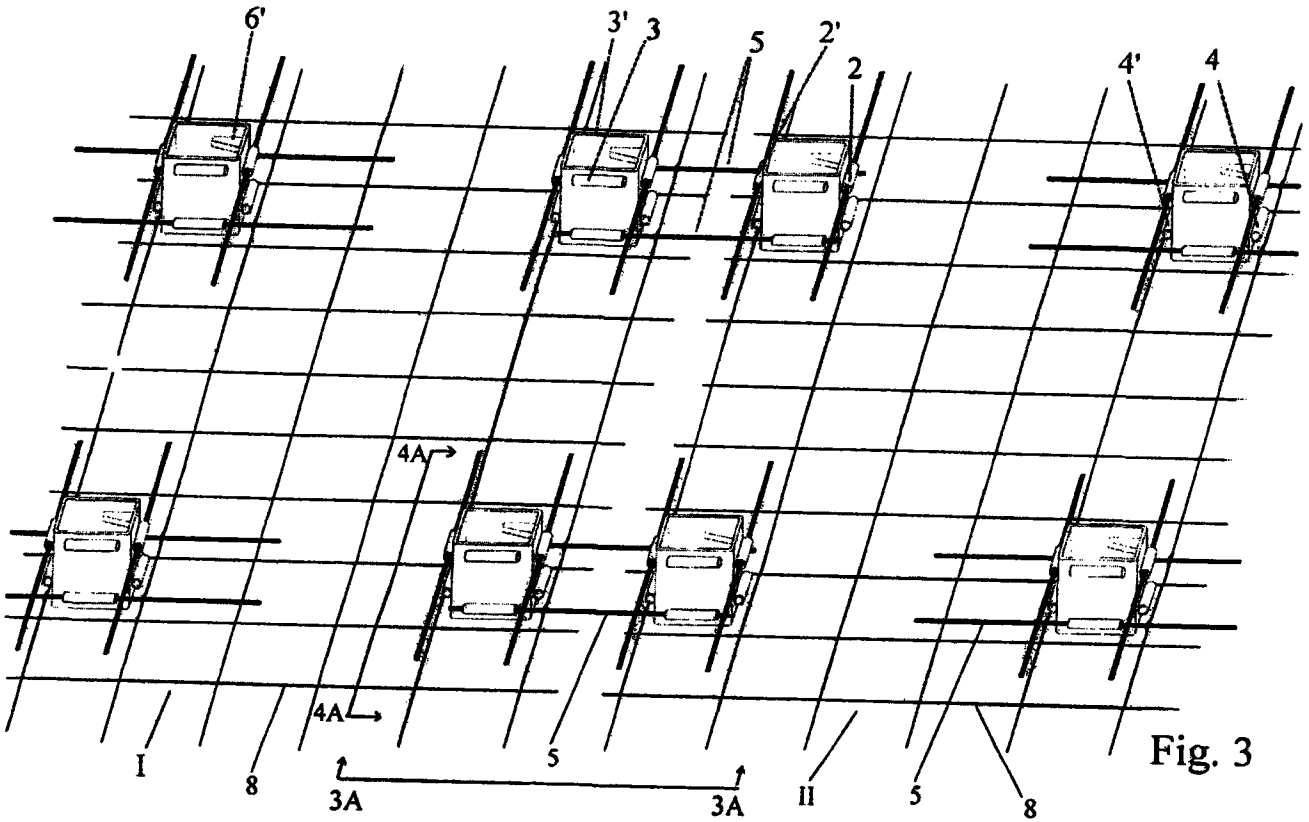
FIG. 3 is a perspective view showing the bonding of two adjoining sections of the first (lower) mesh of the forging with the surfaces of the two sections aligned in coplanar relation.
Figure 3A:
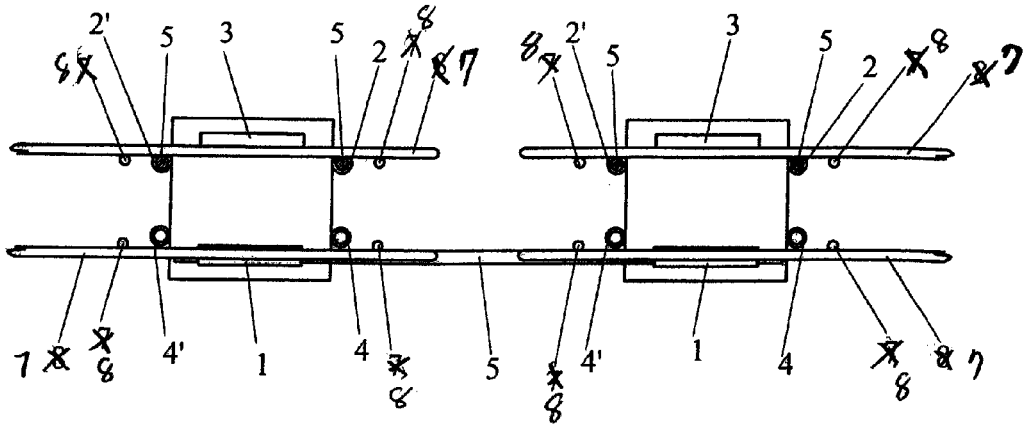
FIGS. 3A and 4A are sectional views taken on the lines 3A-3A and 4A-4A of FIG. 3, showing the next step in the creation of the forging, when both the first (lower) and the second (upper) meshes are mounted on the holders.
Figure 4A:
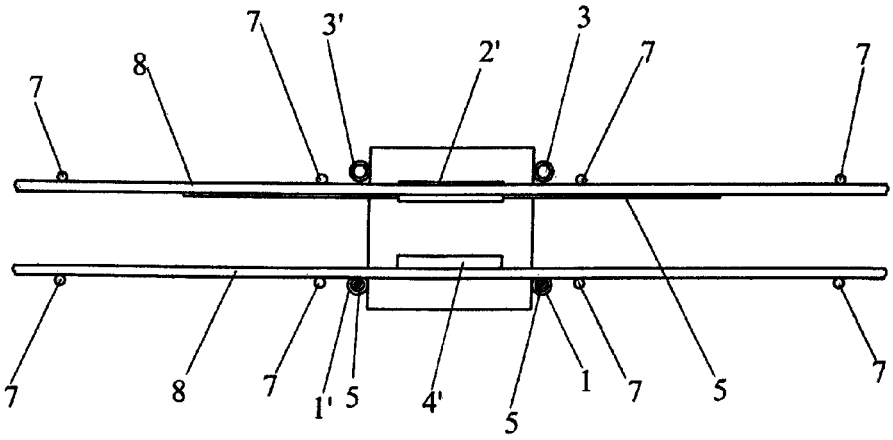

The first (lower) mesh of the welded wire fabric (7,8) is situated above the rods (5) mounted in the lower tubes (1, 1'), according to FIGS. 3, 3A and 4A.

Figure 1A:
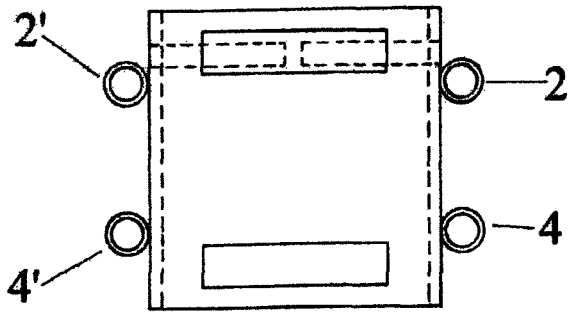
FIG. 1A shows the left elevation.
Figure 1B:
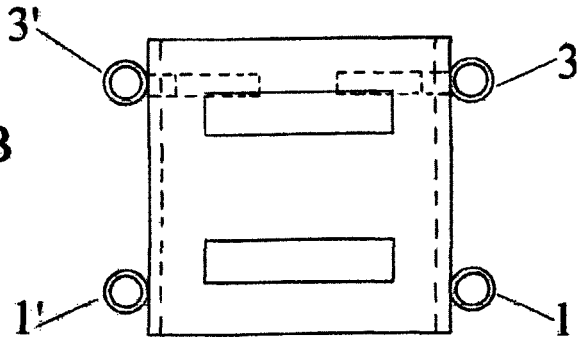
FIG. 1B shows the front elevation.
Figure 1C:
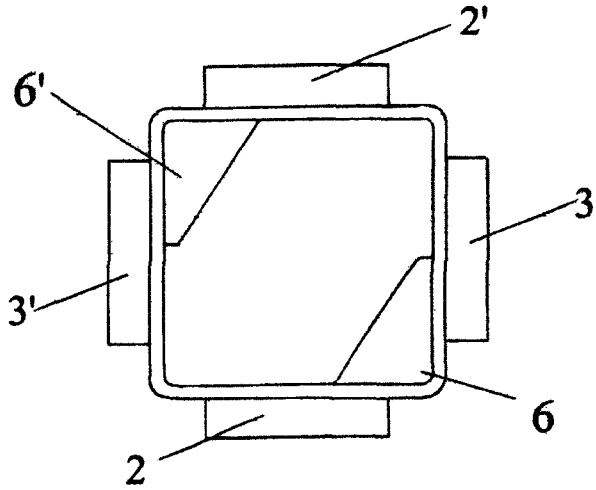
FIG. 1C shows the plan view of the holder that is the subject of the present invention.
Figure 2:
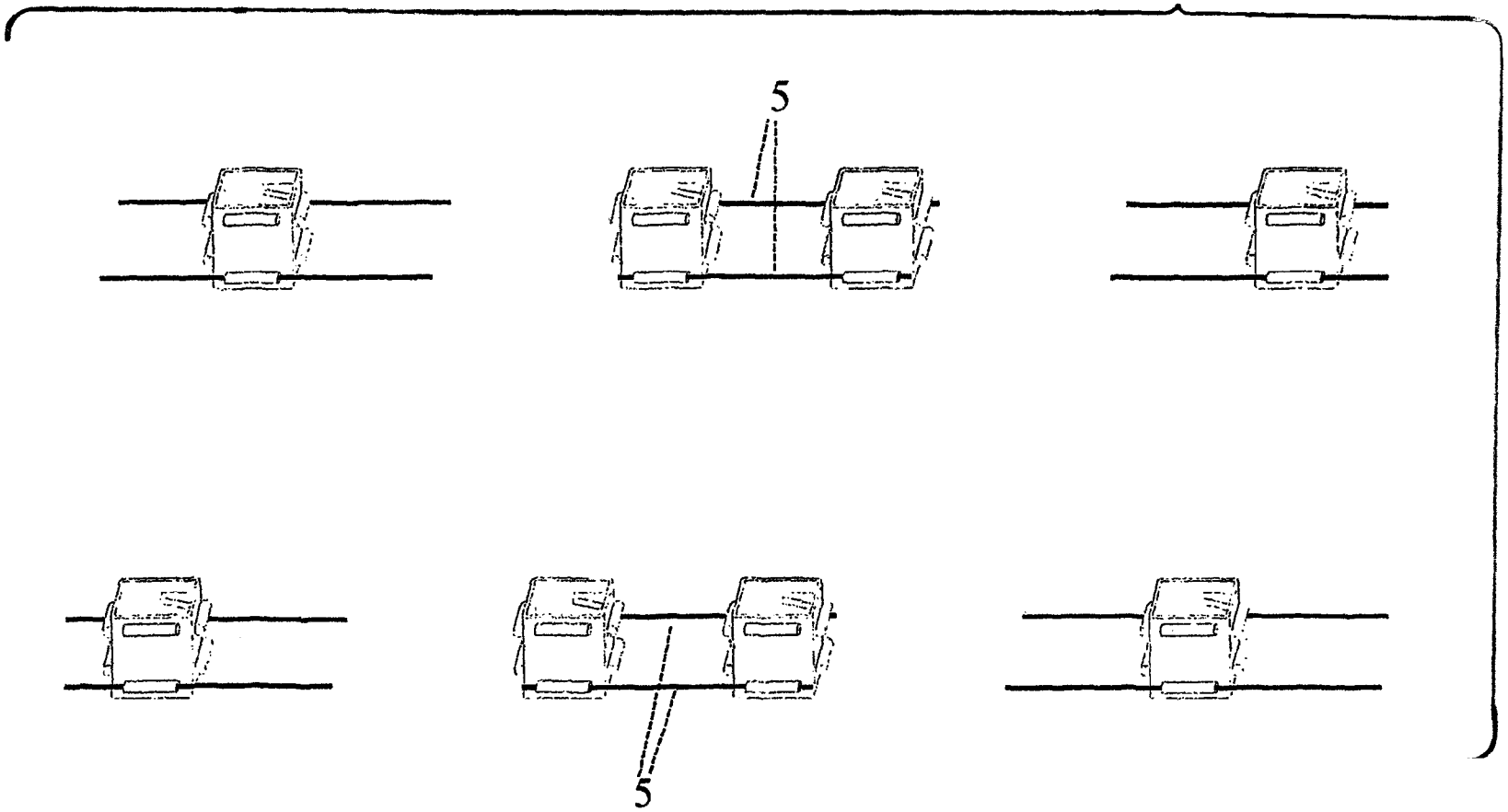
FIG. 2 is a perspective view showing the positioning of eight holders in a first phase of the creation of the forging prior to the installation of the lower and upper woven wire mesh sections.

As shown in FIG. 3, both sections (I and II) of the first mesh (7,8) of the structure of the welded wire fabric is situated above rods (5) which are inserted in the lower tubes (1 and 1') shown in FIG. 2. As shown in FIG. 3A, the adjoining sections (I and II) of the second mesh grid (13) are not interconnected prior to installation, and are situated above the rods (5) which are inserted in the lower tubes 2 and 2'.

To interconnect the adjoining mesh sections (I and II), the rods (5) will be inserted in the lower tubes of the holders (6) in both sections (I and II), spanning between and connecting both sections of the mesh structure.

The mesh is formed by longitudinal wires (8) and transverse wires (7), arranged some on top of others, and securing the bonding at the points of contact by welding. As shown in FIG. 4A, the rods (5) in the lower tubes (1 and 1') will be situated on the same plane and parallel to the lower wires (8) of the mesh, holding the longitudinal wires perpendicular to the transverse ones (7).

The separation between the lower tubes and upper tubes for positioning the mesh will be sufficient for the entry of the concrete, on the understanding that there may be little separation between the holders in the pouring which will put the consistency of the future floating slab at risk.

Figure 5:
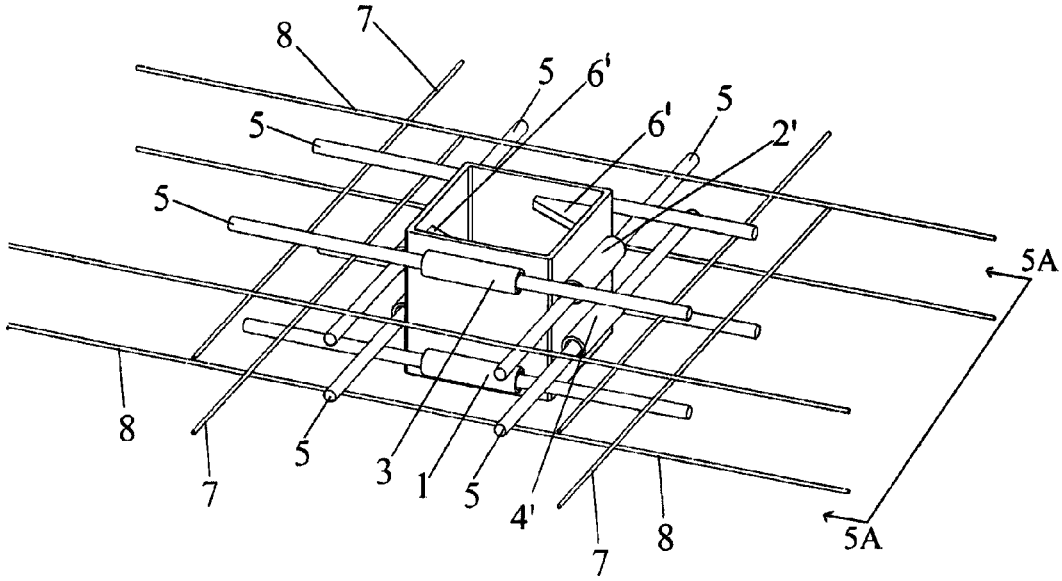
FIG. 5 is a perspective view showing the creation of a modified embodiment of the forging, which uses rods in all of the eight tubes of the holder of the present invention.
Figure 5A:
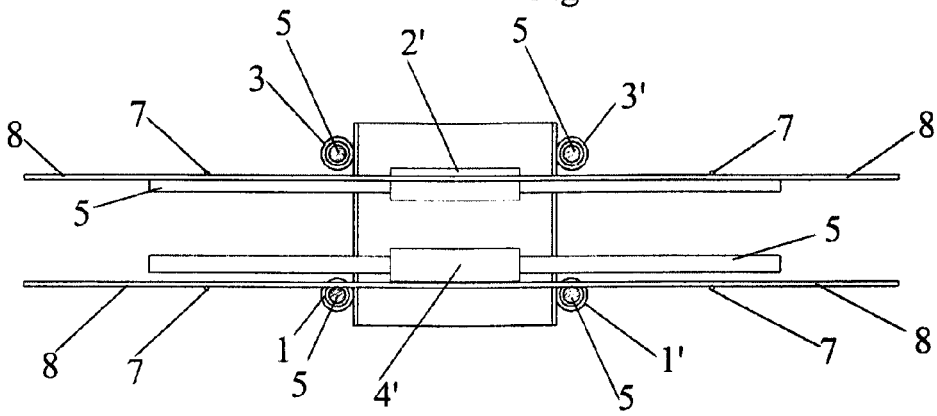
FIG. 5A is a sectional view taken on the line 5A-5A of FIG. 5.

In the holders (6) belonging to two mesh sections that are located close to the corners, rods (5) will be inserted into the upper tubes (2,2'). As shown in FIGS. 5 and 5A, additional rods 5 (not shown in FIGS. 3, 3A and 4A) may be inserted in the tubes (3, 3') on the same side as the lower tubes (5,5'), whose rods support the first mesh, and inserted in the two adjacent sections It will also be used for anchoring the structure and the mesh is not raised when exerting pressure in an opposite zone. In FIG. 3 is only shown the first (lower) welded wire mesh (7,8), FIGS. 3A and 3B illustrate the second (upper) mesh (7,8) superimposed on the upper rods (5) in the manner that is described.

FIG. 3 shows two joined mesh sections (I, II) beginning at the joined corners, and it has to be understood that the sections (I, II) are not shown complete in the horizontal direction.

As shown in FIGS. 5 and 5A, the other two tubes (4,4') that are in the structure of the holder (6), arranged parallel to the upper tubes (2.2') for the installation of the rods that support the second mesh and in a plane lower than those will be used for the installation of other additional rods when the slab has to support major loads.

The holder has a lid and a holder base coated with rustproof paint, and both are assembled by compression to avoid the entrance of the pourable concrete mix. As a complement, the lid is arranged sealed with silicone. The lid and holder base are painted different colors for quickly checking before pouring the concrete whether any of the holders are in the incorrect position.

When the concrete has set, the lids of the holders will be removed, and shock absorbers will then be placed which will make the raising of the slab possible. In this most suitable embodiment, another shock absorber, in this case, a high-frequency, silent-block-type shock absorber, will be placed on the bottom, which will facilitate the movement of the shock absorber arranged above same.

It should be understood that the present invention was described according to the preferred embodiment of same; therefore, it may be susceptible to modifications in shape, size and materials, provided that said changes do not substantially vary the features of the present invention as they are claimed below.

The invention claimed is:

1. For use in floating floor slabs comprising a poured concrete forging having a height, support structure for mechanical accessories which are operable in the lifting phase of the slab comprising at least a first layer of welded wire fabric mesh having transverse and longitudinal wires spaced apart to form first interstices, a holder in the form of a cube positioned and fitted within the interstices of the welded wire fabric mesh, said holder having a hollow interior dimensioned for accommodating a mechanical accessory, said holder having four sides, namely opposite front, rear, right and left sides, the dimensions of all of said four sides being less than the spacing of the longitudinal and transverse wires in the mesh, the height of said sides corresponding to the height of the forging, at least an opposite two of said four sides of said holder having a first horizontal tube, whose length is less than that of the side of the holder, said tubes having a hollow cross section, and rods having a central portion dimensioned to telescopically engage said tubes and end portions projecting beyond said sides a distance to underlie said wires of the mesh on opposite sides of the interstice, so as to support the welded wire fabric mesh.

2. The support structure according to claim 1, including a second layer of welded wire fabric mesh having transverse and longitudinal wires spaced apart to form second interstices in vertical registry with said first interstices, said holder having first and second horizontal tubes on at least two opposite sides, said upper and lower tubes being positioned on each side in a same position as the upper and lower tubes on the opposite side of the holder.

3. The support structure according to claim 2, wherein said holder has a holder base at the bottoms and a lid at the tops of said four sides characterized in that the upper and lower tubes of two of the sides are located close to the holder lid the holder base, respectively.

4. The support structure of a holder according to claim 3 with said rods mounted in said hollow tubes, and upper and lower meshes having upper wires crossing lower wires, characterized in that the lower mesh is positioned above the rods arranged in said lower tubes which are close to the holder base.

5. The support structure in accordance with claim 4, characterized in that the second mesh is positioned above the rods of the upper tubes of the other two sides of the holder.

6. A holder for being positioned in floating floor slabs in accordance with claim 2, characterized in that on the other two of said four sides, the upper tube is located in a position lower than the upper tube of its adjoining sides and the lower tube is located in a position higher than the lower tubes of its adjoining sides.

7. The support structure of a holder according to claim 1 with upper and lower meshes having upper wires crossing lower wires, characterized in that the meshes are positioned such that their upper wires are perpendicular to the rods and above said rods on two opposite sides of the holder, and the lower wires are parallel to the rods on the other two sides of the holder.

8. The support structure of two holders according to claim 1 with two meshes with substantially coplanar aligned fabric surfaces, one of said two holders being mounted in a mesh interstice of the first of said two meshes, and the other of said holders being mounted in a mesh interstice of the second of said two meshes, and at least one rod extending between said two holders and having its opposite ends telescopically engaged in said hollow horizontal tubes of the two holders, said aligned coplanar surfaces being supported by said at least one rod extending between said two holders.

9. The support structure according to claim 1 with rods telescopically engaged in all of the tubes of the holder whereby major loads may be supported by the floating slab.

10. The support structure of multiple holders according to claim 1 with multiple mesh surfaces having edges adjacent each other and rods telescopically engaged in the holders next to said adjacent edges of the two mesh surfaces, said rods linking the multiple holders.

11. A method for the positioning and the installing holders in floating floor slabs having a poured concrete supporting base of a given height with welded wire fabric composed of at least one layer, said layer being in the form of a grid with mesh interstices, and including rebar rods adapted to be connected to said holders within said floating floor slab, said holders, after the setting of the poured concrete, adapted to accommodate mechanical accessories, including the steps of providing a plurality of holders in the shape of a cube with four sides and a hollow interior, the widths of said sides being less than the width of the mesh interstices of the mesh, and the height of said sides corresponding to the given height of the concrete supporting base, each holder having horizontal tubes on its sides, whose lengths are less than the width of the holder, and with a hollow cross section of a size allowing telescopic insertion of said rebar rods, mounting said holders in the mesh interstices said fabric before pouring the concrete supporting base by telescopically inserting rebar rods through said upper and lower tubes, and pouring said concrete supporting base, allowing it to set, and then installing mechanical accessories in said holders.

12. A method according to claim 11 wherein said welded wire fabric has upper and lower layers, and said holder s have upper and lower tubes, including the steps of telescopically positioning rebar rods both in the lower tubes above the lower wire fabric layer, and in the upper tubes below the upper layer.

13. A method according to claim 11 wherein said welded wire fabric is formed of at least two adjoining coplanar sections with holders having tubes in each section, including the step of positioning rebar rods to span between the holders in said adjoining sections.

14. The support structure according to claim 1 wherein said rods have an outer dimension, and said tubes have an interior dimension adapted to telescopically receive said rods.

15. The method according to claim 11 wherein said step of providing holders provides holders having an interior dimension larger than the outer dimension of the rebar rods.

* * * * *